US007048400B2

(12) United States Patent
Murasko et al.

(10) Patent No.: US 7,048,400 B2
(45) Date of Patent: May 23, 2006

(54) INTEGRATED ILLUMINATION SYSTEM

(75) Inventors: Matthew Murasko, Manhattan Beach, CA (US); Patrick J. Kinlen, Fenton, MO (US)

(73) Assignee: Lumimove, Inc., Fenton, MO (US)

( * ) Notice: Subject to any disclaimer, the term of this patent is extended or adjusted under 35 U.S.C. 154(b) by 220 days.

(21) Appl. No.: 10/104,136

(22) Filed: Mar. 22, 2002

(65) Prior Publication Data

US 2002/0159245 A1 Oct. 31, 2002

Related U.S. Application Data

(60) Provisional application No. 60/278,021, filed on Mar. 22, 2001, provisional application No. 60/277,827, filed on Mar. 22, 2001.

(51) Int. Cl.
*F21V 9/16* (2006.01)

(52) U.S. Cl. ..... 362/84; 362/183; 362/200; 362/812; 313/506; 313/507; 40/544

(58) Field of Classification Search ..... 362/84, 362/183, 812, 276, 200, 201, 189; 313/506, 313/507; 40/544
See application file for complete search history.

(56) References Cited

U.S. PATENT DOCUMENTS

| | | | |
|---|---|---|---|
| 1,163,637 | A | 12/1915 | Dick |
| 2,090,248 | A | 8/1937 | Chakow |
| 3,007,070 | A | 10/1961 | Cargill, Jr. |
| 3,317,722 | A | 5/1967 | Whitney |
| 3,358,137 | A | 12/1967 | Sinclair et al. |
| 3,581,308 | A | 5/1971 | McNaney |

(Continued)

FOREIGN PATENT DOCUMENTS

| | | | |
|---|---|---|---|
| DE | 3042159 | * | 6/1982 |

(Continued)

OTHER PUBLICATIONS

Partial Translation of Japanese Utility Model Application No. 63-115851 corresponding to Japanese Unexamined Utility Model (Kokai) No. 2-36893.

(Continued)

*Primary Examiner*—Stephen F Husar
(74) *Attorney, Agent, or Firm*—Nelson Mullins Riley & Scarborough, LLP

(57) ABSTRACT

Integrated illumination systems employing illumination devices formed onto substrates are described. According to one embodiment, the display system combines an electroluminescent lamp, a photocell, a power supply receiving energy from the photocell and discharging electrical energy to the EL lamp, and, optionally, a control switch to manage the intervals of electrical energy discharge to the EL lamp for illumination; the components of the d lay system combining to provide illumination for an object, such as a sign. According to another embodiment, a photocell, power supply and light emitting device are each formed onto a single substrate to form a totally self-contained, self-powered illuminating device. According to another embodiment, an electroluminescent lamp is provided to form an illuminated decal. The EL lamp may be configured to have a front illumination surface and a back mounting surface, with a decal backing attached to the back mounting surface. The decal backing is configured to be affixed to various objects, such as vehicles, to provide an illumination source thereon. Alternatively, a magnetic material may be affixed to the back mounting surface of the EL lamp to replace the decal backing.

32 Claims, 6 Drawing Sheets

U.S. PATENT DOCUMENTS 3,619,714 A 11/1971 Evans et al.
3,648,235 A 3/1972 Cahill
3,793,517 A 2/1974 Cartini
4,010,032 A 3/1977 Ono et al.
4,020,389 A 4/1977 Dickson et al.
4,090,232 A 5/1978 Golden
4,138,620 A 2/1979 Dickson
4,143,297 A 3/1979 Fischer
4,143,404 A 3/1979 Armstrong et al.
4,195,328 A 3/1980 Harris, Jr.
4,225,408 A 9/1980 Barlow et al.
4,234,907 A 11/1980 Daniel
4,266,164 A 5/1981 Schroeder
4,279,726 A 7/1981 Baird et al.
4,319,308 A 3/1982 Ippoliti et al.
4,480,293 A 10/1984 Wells
4,486,487 A 12/1984 Skarp
4,559,586 A 12/1985 Slarve
4,570,206 A 2/1986 Deutsch
4,571,350 A 2/1986 Parker et al.
4,617,195 A 10/1986 Mental
4,626,742 A 12/1986 Mental
4,645,970 A 2/1987 Murphy
4,652,981 A 3/1987 Glynn
4,667,274 A 5/1987 Daniel
4,709,307 A 11/1987 Branom
4,748,375 A 5/1988 Lindmayer
4,803,402 A 2/1989 Raber et al.
4,829,213 A 5/1989 Pecile et al.
4,862,331 A 8/1989 Hanabusa
4,875,144 A 10/1989 Wainwright
4,877,995 A 10/1989 Thioulouse et al.
4,887,003 A 12/1989 Parker
4,891,736 A 1/1990 Gouda
4,893,356 A 1/1990 Waters
4,901,211 A 2/1990 Shen
4,904,901 A 2/1990 Simopoulos et al.
4,945,458 A 7/1990 Batts et al.
D310,434 S 9/1990 Breece
4,956,752 A 9/1990 Foglietti
4,999,936 A 3/1991 Calamia et al.
5,005,306 A 4/1991 Kinstler
5,019,438 A 5/1991 Rapisarda
5,040,099 A 8/1991 Harris
5,051,654 A 9/1991 Nativi et al.
5,067,063 A 11/1991 Granneman et al.
5,111,366 A 5/1992 Rife et al.
D326,924 S 6/1992 Carroll
5,121,234 A 6/1992 Kucera
5,122,939 A 6/1992 Kazdan et al.
5,128,844 A 7/1992 Landais
5,138,539 A 8/1992 Honda et al.
5,151,678 A 9/1992 Veltri et al.
5,198,723 A 3/1993 Parker
5,293,098 A 3/1994 Brownell
5,317,488 A 5/1994 Penrod
5,319,282 A 6/1994 Winsor
5,352,951 A 10/1994 Kardon et al.
5,400,047 A 3/1995 Beesely
5,426,792 A 6/1995 Murasko
5,466,990 A 11/1995 Winsor
5,469,019 A 11/1995 Mori
5,469,020 A 11/1995 Herrick
5,491,377 A 2/1996 Janusauskas
5,497,572 A 3/1996 Hoffman
5,502,357 A 3/1996 Kimball
5,518,561 A * 5/1996 Rosa ..... 40/544
5,533,289 A 7/1996 Hoffman
5,552,679 A * 9/1996 Murasko ..... 313/506
5,565,733 A 10/1996 Krafcik et al.
5,568,016 A 10/1996 Beard
5,572,817 A 11/1996 Chien
5,597,183 A 1/1997 Johnson
5,618,100 A * 4/1997 Glynn ..... 362/183
5,634,411 A 6/1997 Chasan
5,663,573 A 9/1997 Epstein et al.
5,667,417 A 9/1997 Stevenson
5,667,724 A 9/1997 Petersen
5,697,175 A 12/1997 Schwartz
5,697,305 A 12/1997 Chasan et al.
5,703,436 A 12/1997 Forrest et al.
5,814,947 A 9/1998 Brownell
5,853,905 A 12/1998 So et al.
5,856,029 A 1/1999 Burrows
5,856,030 A 1/1999 Burrows
5,856,031 A 1/1999 Burrows
5,911,496 A 6/1999 Hojnacki
5,957,564 A 9/1999 Bruce et al.
5,965,981 A 10/1999 Inoguchi et al.
5,976,613 A 11/1999 Janusauskas
5,980,976 A 11/1999 Burrows
6,013,985 A 1/2000 Green et al.
6,031,468 A * 2/2000 Tsao et al. ..... 362/183
6,050,010 A 4/2000 Garcia et al.
6,060,838 A 5/2000 Cantoni et al.
6,069,444 A 5/2000 Krafcik et al.
6,107,213 A 8/2000 Tayanaka
6,116,745 A 9/2000 Yei
6,137,221 A 10/2000 Roitman et al.
6,157,138 A 12/2000 Andersson
6,168,283 B1 1/2001 Howell
6,203,391 B1 3/2001 Murasko
6,205,690 B1 3/2001 Heropoulos et al.
6,261,633 B1 7/2001 Burrows
6,262,531 B1 7/2001 Inoguchi et al.
6,310,589 B1 10/2001 Nishigaki et al.
6,353,291 B1 3/2002 Borgogno et al.
6,356,031 B1 * 3/2002 Thagard et al. ..... 313/507

FOREIGN PATENT DOCUMENTS

EP 166534 * 1/1986
FR 1401264 * 4/1965
GB 2107039 * 4/1983

OTHER PUBLICATIONS

Japanese Unexamined Patent Publication (Kokai) No. 6-275382.
Japanese Unexamined Patent Publication (Kokai) No. 63-299091.
Japanese Unexamined Patent Publication (Kokai) No. 3-163794.
Japanese Unexamined Patent Publication (Kokai) No. 5-129081.
Japanese Unexamined Patent Publication (Kokai) No. 60-218797.
Japanese Unexamined Patent Publication (Kokai) No. 3-133090.
Japanese Unexamined Utility Model Publication (Kokai) No. 63-39895.
Japanese Unexamined Patent Publication (Kokai) No. 60-133692.
Let There Be Light: Screen Printing EL Lamps For Membrane Switches, Screenprinting, Graphics and Industrial Printing, dated Jan. 1999, 5 pages.
Processing Guide for DuPont Luxprint* Electroluminescent Inks, DuPont Photopolymer & Electronic Materials, dated Nov. 1997, 6 pages.

* cited by examiner

INTEGRATED ILLUMINATION SYSTEM

This application claims the benefit of Provisional Application Ser. Nos. 60/278,021 and 60/277,827, filed Mar. 22, 2001.

BACKGROUND OF THE INVENTION

Field of the Invention

This invention relates generally to illumination devices, and more particularly, to illumination devices formed onto substrates.

Problem

Traditional illumination sources, such as light bulbs (e.g., incandescent and fluorescent) and neon-filled tubing, can be configured to provide illumination for a variety of objects, such as signage, vehicles, etc., and for a variety of purposes, such as for safety, identification, or advertisement. However, these illumination sources are often an unacceptable solution for many applications because they are generally breakable, costly to ship, require frequent maintenance, and generally unable to deliver both movement of different elements of a lighted display and the ability to be formed to represent exact logos or icon images. Further, the bulk and size of traditional illumination sources can reduce the utility of the object that is being illuminated. Thus, a more integrated, compact illumination system is desired for providing illumination in a variety of situations, such as for illuminating signage and other objects.

Solution

The present invention employs illumination devices formed onto substrates to form an integrated illumination system. In one aspect, the display system combines an electroluminescent lamp, a photocell, a power supply receiving energy from the photocell and discharging electrical energy to the EL lamp, and a control switch to manage the intervals of electrical energy discharge to the EL lamp for illumination; the components of the display system combining to provide illumination for an object, such as a sign. The electroluminescent lamp has a front illumination surface and a back surface configured for attachment to a first surface of an object. The photocell has a surface for receiving solar energy or radiation. In operation, the photocell will receive solar energy during daylight hours. The solar energy is converted into electrical energy to directly power the EL lamp or to be stored in the power supply for liter discharged to the EL lamp. The control switch will determine whether it is an appropriate time for the EL lamp to illuminate, and will thereby control electrical energy discharge from the power supply.

In another aspect, the present invention combines a photocell, power supply and light emitting device onto a single substrate to form a totally self-contained, self-powered illuminating device. The photocell receives solar radiation and converts it to electrical energy. The power supply receives the electrical energy from the photocell and stores it until needed. The light emitting device receives the electrical energy from the power supply and uses such energy to produce illumination. Each of the photocell, power supply, and light emitting device are ideally printed onto the substrate as thin, film-like components such that the illuminating device may be used in almost any location where illumination is desired.

In another aspect, an electroluminescent lamp is provided to form an illuminated decal. The EL lamp may be configured to have a front illumination surface and a back mounting surface, with a decal backing attached to the back mounting surface. The decal backing is configured to be affixed to various objects, such as vehicles, to provide an illumination source thereon. Alternatively, a magnetic material may be affixed to the back mounting surface of the EL lamp to replace the decal backing. The magnetic material facilitates the EL lamp being affixed to objects that are magnetically attracted to the magnetic material, such as steel or iron.

Other advantages and components of the present invention will become apparent from the following description taken in conjunction with the accompanying drawings, which constitute a part of this specification and wherein are set forth exemplary embodiments of the present invention to illustrate various features thereof.

BRIEF DESCRIPTION OF THE DRAWINGS

Figure I is a side elevational view of an assembly substrate, power supply, and light emitting device in accordance with an embodiment of the present invention.

DETAILED DESCRIPTION OF THE INVENTION

The present invention provides illumination devices that may be used for a variety of applications, such as general illumination or illumination in association with a specific object (e.g., a sign, a buoy, etc.). In embodiments of the present invention incorporating electroluminescent lamps as sources of illumination, certain components of such EL lamps may be formed together as disclosed in U.S. Pat. No. 6,203,391 of Murasko, the teachings of which are incorporated by reference herewith. The '391 patent discloses processes for forming electroluminescent signs by combining electroluminescent lamp components with a sign substrate.

Figure 1:
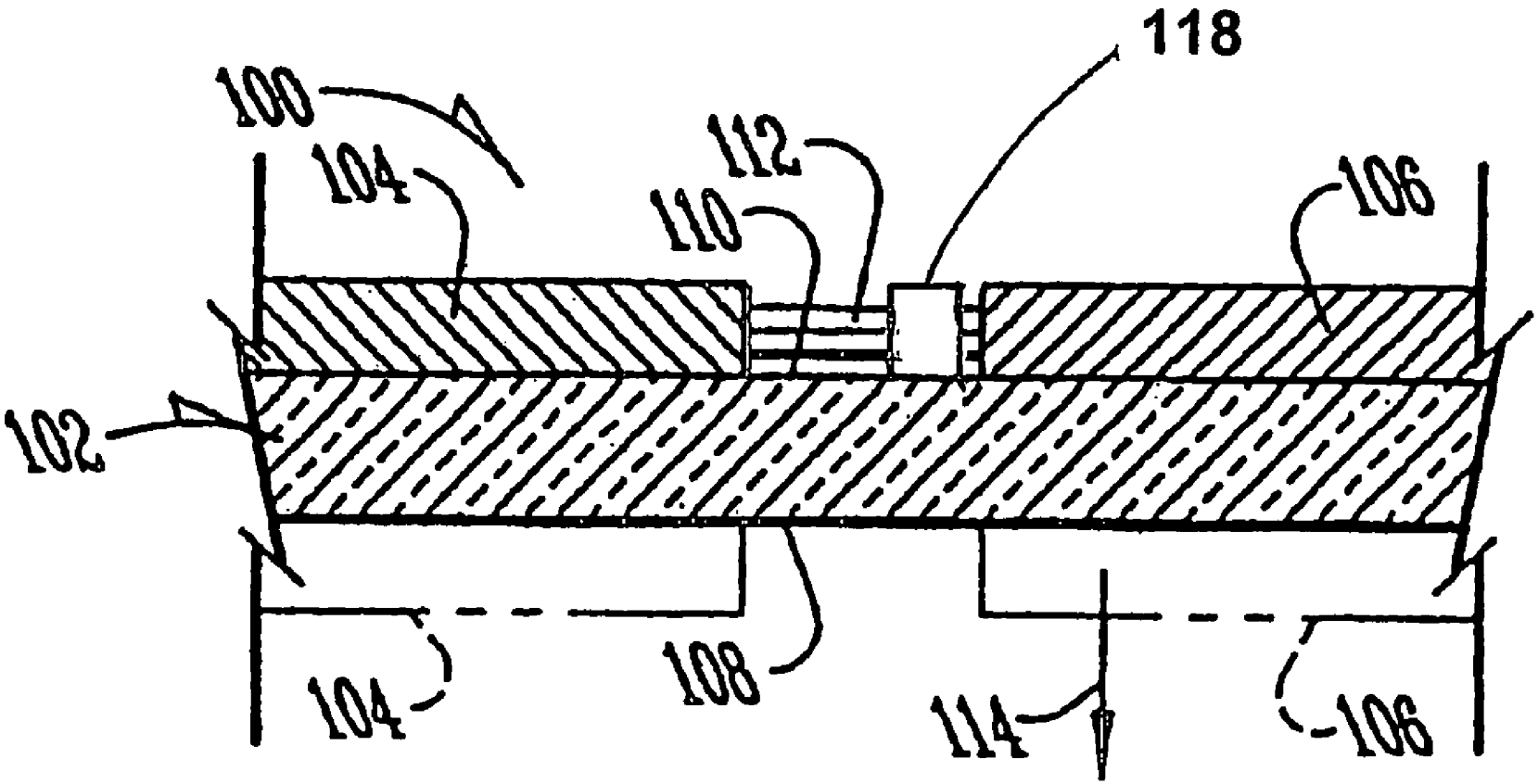

A self-powered illumination device 100 is shown in FIG. 1 and comprises an assembly substrate 102, a power supply 104, and a light emitting device 106. Assembly substrate 102 provides a generally thin-profile, elongate foundation upon which power supply 104 and light emitting device 106 are formed. Assembly substrate 102 has a front surface 108 where illumination of light emitting device 106 may be viewed, and a back surface 110 upon which power supply 104 and device 106 are formed, each adjacent to the other. Preferably, power supply 104 is a thin-film battery and light emitting device 106 is an electroluminescent lamp, both of which are printed onto assembly substrate back surface 110. Battery 104 may be configured to be rechargeable or, if only a one-time illumination source is needed, nonrechargeable. Additionally, assembly substrate 102 is made of light-transmissive materials (i.e. transparent or translucent materials) such as glass, plexi-glass, plastic (polycarbonate, etc.), and the like. The light-transmissive properties of the assembly substrate 102 allow the viewing of the illumination of light emitting device 106 through substrate 102. Assembly substrate 102 should also be electrically insulative to prevent short circuits of illumination device 100 due to exposure to environmental conditions. Light is primarily emitted in the direction of arrow 114.

According to another embodiment, power supply 104 and light emitting device 106 could be formed on front surface 108 of assembly substrate 102 such that illumination emanating from device 106 would not have to travel through substrate 102 to be viewed. Thus, assembly substrate 102 would not have to be light-transmissive, and could be optionally be made of a material such as glass, plexi-glass, plastic (polycarbonate, etc.), metals (e.g. aluminum) or cardboard. A light-transmissive electrically insulative material, such as an ultraviolet coating, may be positioned to overlie power supply 104 and light emitting device 106 to reduce the risk of electric shock by contacting power supply 104 and device 106, and to prevent short circuits due to exposure to environmental conditions.

Electroluminescent lamp 106 may be fabricated according to the teachings of the '391 patent. The materials used for the EL lamp components may also include those disclosed in U.S. patent application Ser. No. 09/815,078, filed Mar. 22, 2001, for an "Electroluminescent Multiple Segment Display Device", the teachings of which are incorporated by reference herewith.

Figure 9:
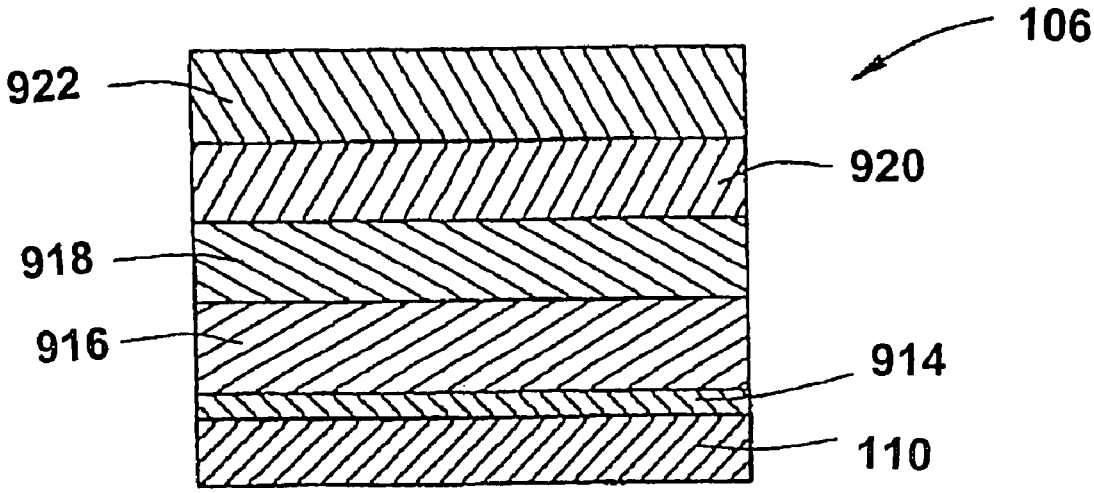
FIG. 9 is a front cutaway view of an electroluminescent lamp of the type used in accordance with an embodiment of the present invention.

The component layers of electroluminescent lamp 106 are preferably formed in a reverse build on assembly substrate back surface 110. In this arrangement, as shown in FIG. 9 the EL lamp comprises a transparent front electrode formed on substrate back surface 110, a light emitting layer 916 formed on the transparent front electrode, if an electroluminescent phosphor is used for the light emitting layer, a dielectric layer 918 formed on the light emitting layer, a rear electrode 920 formed on the light emitting layer, or if the optional dielectric layer is provided, the rear electrode is formed on such dielectric layer, and a protective coating layer 922 that may be an ultraviolet (UV) coating. Each of the component layers of the EL lamp may be successively applied onto substrate 102 by a variety of means, including stenciling, flat coating, brushing, rolling, and spraying, but preferably are printed onto the substrate by screen or ink jet printing. These EL lamp components may be made from the following materials: the transparent front electrode may be fabricated from organics, such as polyaniline, polypyrrole, poly-phenyleneamine-imine, and polyethylene-dioxithiophene, or inorganics, such as indium-tin-oxide; the light emitting layer may be fabricated from organics, such as light-emitting polymers/organic light emitting diodes, or non-organics, such as phosphor layer of electroluminescent particles, e.g., zinc sulfide doped with copper or manganese which are dispersed in a polymeric binder; the dielectric layer of high dielectric constant material such as barium titanate; and the rear electrode may be fabricated from organics, such as polyaniline, polypyrrole, poly-phenyleneamine-imine, and polyethylene-dioxithiophene, which is available under the trade name "Orgacon" from Agfa Corp. of Ridgefield Park, N.J., or inorganics, such as silver or carbon particles dispersed in a polymeric ink. Preferably, to minimize the drain of electrical energy from power supply 104 while maintaining adequate illumination levels for the illumination device 100, the light emitting layer is made of a light emitting polymer that requires low voltage for operation, typically about 10 volts or less. Optionally, a background layer having certain transparent and optically opaque areas formed by, for example, colored printable inks, can be formed onto assembly substrate back surface 110 prior to the EL lamp being formed thereon and at a location where EL 106 is to be positioned. Such a background layer may form a specific illuminated design made into the shape of illuminated images (e.g., wording, logos, icons, etc.). Additionally, illuminated images can be formed by positioning the light emitting layer of the EL lamp in the form of such images.

Leads 112 electrically connect power supply 104 to light emitting device 106 to bring electrical energy to device 106. Where device 106 is an electroluminescent lamp, leads 112 connect to front and rear electrodes of the lamp. Preferably, leads 112 comprise a front outlining electrode lead configured to substantially surround and electrically contact the transparent front electrode of the EL lamp, and a rear electrode lead configured to electrically contact the rear electrode of the EL lamp. A switch 118 can be provided to manage the discharge cycles of power supply 104 to light emitting device 106 for illumination thereof. Switch 118 can be light-activated day/night switches that sense the level of ambient light at illumination device 100 such that when ambient light conditions are reduced to a predetermined level, switch 118 allows discharge of electrical energy from power supply 104 to device 106 for illumination. Conversely, upon the ambient light conditions exceeding the predetermined level, the switches 118 shut off the electrical energy discharge and device 106 ceases illuminating. As an alternative to the light-activated switches, switch can be a timer switch (not shown) that controls the discharge of electrical energy from power supply 104 at pre-set time intervals, such as generally at a time that would correspond to dawn and to dusk.

Figure 2:
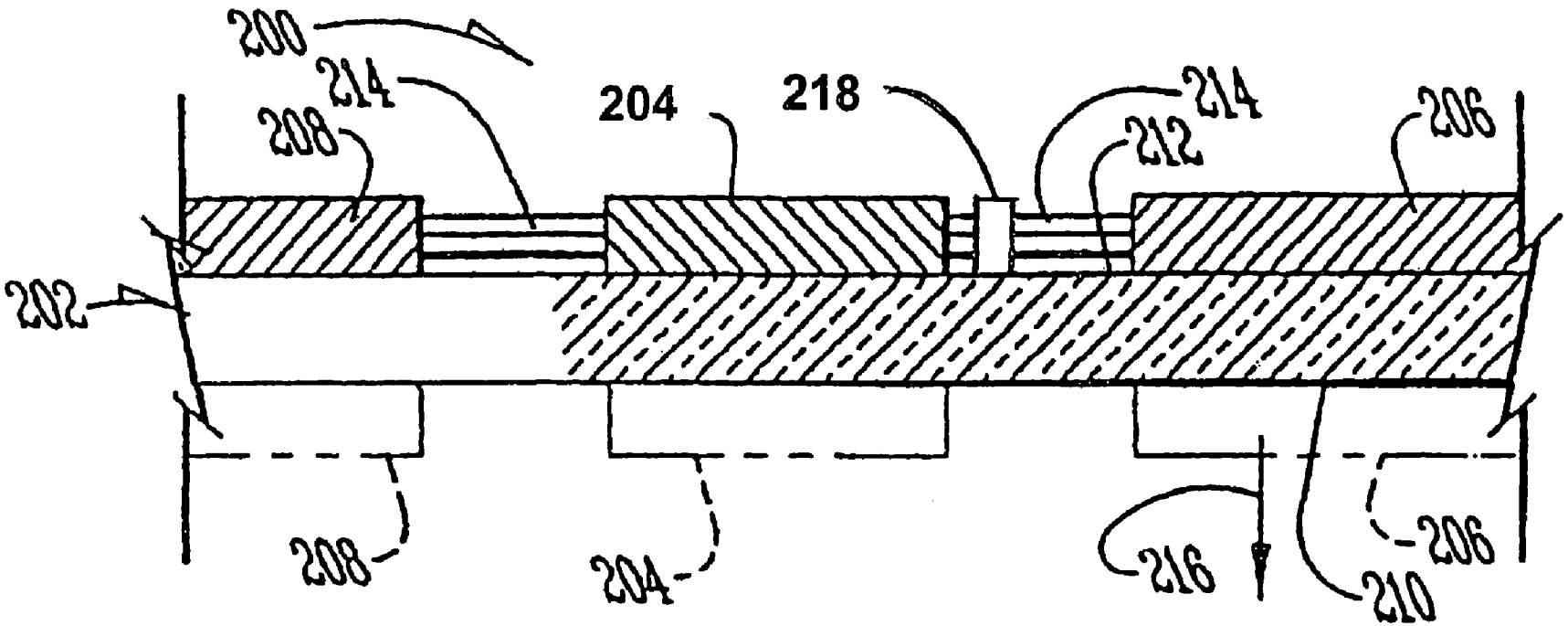
FIG. 2 is a side elevational, view of an assembly substrate, photocell, power supply, and light emitting device in accordance with an embodiment of the present invention.

FIG. 2 provides another embodiment of a self-powered illumination device 200. Similar to the illumination device shown in FIG. 1, the self-powered illumination device 200 comprises an assembly substrate 202, a power supply 204, and a light emitting device 206, but further includes a photocell 208. In this arrangement, photocell 208 receives solar energy or radiation from the ambient environment around illumination device 200 and converts such energy into electrical energy for storage in power supply 204.

Assembly substrate 202 and light emitting device 206 are the same as those corresponding elements in the embodiment of FIG. 1. In this way, assembly substrate 202 provides the foundation upon which power supply 204, light emitting device 206, and photocell 208 are formed. Assembly substrate 202 has a front surface 210 where illumination of light emitting device 206 may be viewed, and a back surface 212 upon which power supply 204, device 206, and photocell 208 are formed, each adjacent to the other. Preferably, power supply 204 is a rechargeable thin-film battery (e.g. a zinc/silver oxide battery) and light emitting device 206 is an electroluminescent lamp, both of which are printed onto assembly substrate back surface 212. Assembly substrate 202 is made of light-transmissive materials (i.e. transparent or translucent) such as glass, plexi-glass, plastic (polycarbonate, etc.), and the like. The light-transmissive properties of the assembly substrate 202 allows both the viewing of the illumination of light emitting device 206 through substrate 202, and the passage of solar energy or radiation through substrate 202 to photocell 208. Assembly substrate 202 may be electrically insulative to prevent short circuits of illumination device 200 due to exposure to environmental conditions. Light is primarily emitted in the direction of arrow 216.

According to another embodiment, power supply 204, light emitting device 206, and photocell 208 could be formed on front surface 210 of assembly substrate 202 such that illumination emanating from device 206 would not have to travel through substrate 202 to be viewed. Thus, assembly substrate 202 would not have to be light-transmissive, and could be optionally made of a material such as glass, plexi-glass, plastic (polycarbonate, etc.), metals (e.g. aluminum) or cardboard. Light-transmissive electrically insulative materials, such as an ultraviolet coatings, may be positioned to overlie power supply 204, light emitting device 266, and optionally, photocell 208 to reduce the risk of electric shock by contacting power supply 204 and device 206 and to prevent short circuits due to exposure to environmental conditions.

Figure 10:
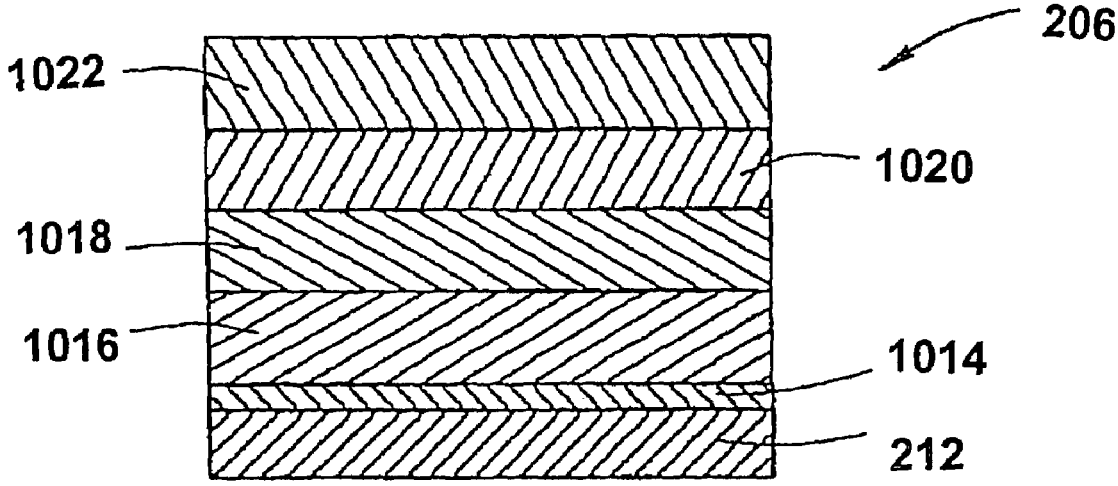
FIG. 10 is a front cutaway view of another electroluminescent lamp of the type used in accordance with an embodiment of the present invention.

The component layers of electroluminescent lamp 206 are the same as those in the embodiment of FIG. 1, and are formed in a reverse build on assembly substrate back surface 212. In this arrangement, as shown in FIG. 10 EL lamp 206 comprises a transparent front electrode 1014 formed on substrate back surface 212, a light emitting layer 1016 formed on the transparent front electrode, if an electroluminescent phosphor is used for the light emitting layer, a dielectric layer 1018 formed on the light emitting layer, a rear electrode 1020 formed on the light emitting layer, or if the optional dielectric layer is provided, the rear electrode is formed on such dielectric layer, and a protective coating layer 1022 that may be an ultraviolet (UV) coating. Preferably, these EL lamp components are screen printed onto the assembly substrate 202.

Photocell 208 receives solar energy and converts such energy into electrical energy to power EL lamp 206. Photocell 208 is made of polysilicon materials and may be configured as an array of photocells formed together. The size of photocell 208 and the number of photocells in an array will depend on the amount of energy that is needed to power the illumination of the light emitting device 206. Leads 214 electrically connect photocell 208 to power supply 104 to transfer electrical energy generated by photocell 208 to power supply 104. Likewise, such leads 214 electrically connect power supply 104 to light emitting device 106 to transfer electrical energy to device 106 for illumination thereof Preferably, a portion of leads 214 comprise a front outlining electrode lead configured to substantially surround and electrically contact the transparent front electrode of the EL lamp, and a rear electrode lead configured to electrically contact the rear electrode of the EL lamp. According to one embodiment where device 206 is an electroluminescent lamp, leads 214 connect to front and rear electrodes of the lamp. A switch 218 can be provided to manage the discharge cycles of power supply 204 to light emitting device 206 for illumination thereof. Switch 218 an be photoactivated day/night switches that sense the level of ambient light at illumination device 200 such that when ambient light conditions are reduced to a predetermined level, the switches allow discharge of electrical energy from power supply 204 to device 206 for illumination. Conversely, upon the ambient light conditions exceed the predetermined level, the switches shut off the electrical energy discharge and device 106 ceases illuminating. In addition, the photo-activated switches could sense when power supply 204 is fully charged and prevent the transfer of electrical energy from photocell 208 to power supply 204 to avoid overcharge damage to the power supply. As an alternative to the photo-activated switches, switch 218 can be a timer switch that allows and disallows discharge of electrical energy from power supply 204 at pre-set time intervals, such as generally at a time that would correspond to dawn and to dusk.

The illumination devices of the embodiments of FIGS. 1 and 2 each provide a self-powered illumination system having a very thin and compact design. The ability to print the photocell, power supply, and light emitting device onto a single, thin-film substrate further enhances the compact nature of the illumination devices. A variety of applications for illumination devices of the present invention may be employed, such as providing illumination for road signs, billboards, signal buoys, location markers, outdoor gear (tents, backpacks, etc.), or for providing a specific illuminated design or image in almost any location. In this way, the illumination devices could be affixed to such objects by a variety of means, such as by heat bonding or by the use of adhesives.

Figure 3:
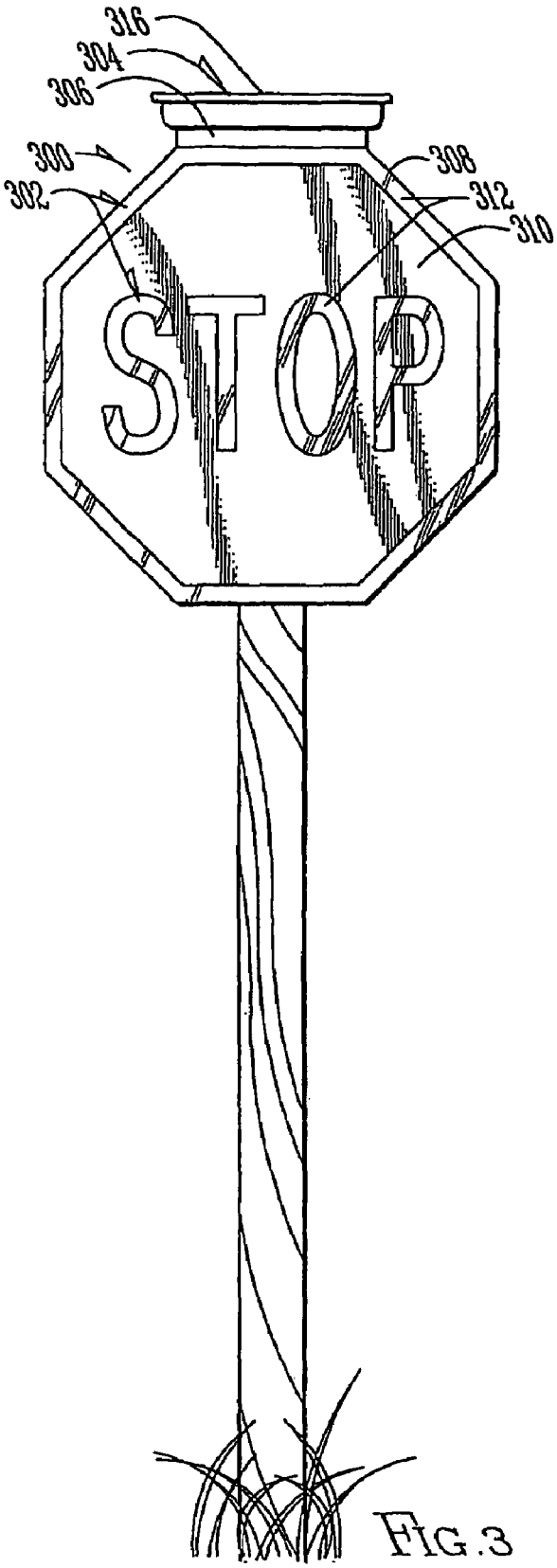
FIG. 3 is a front elevational view of a display system providing illumination for an object in accordance with an embodiment of the present invention.
Figure 4:
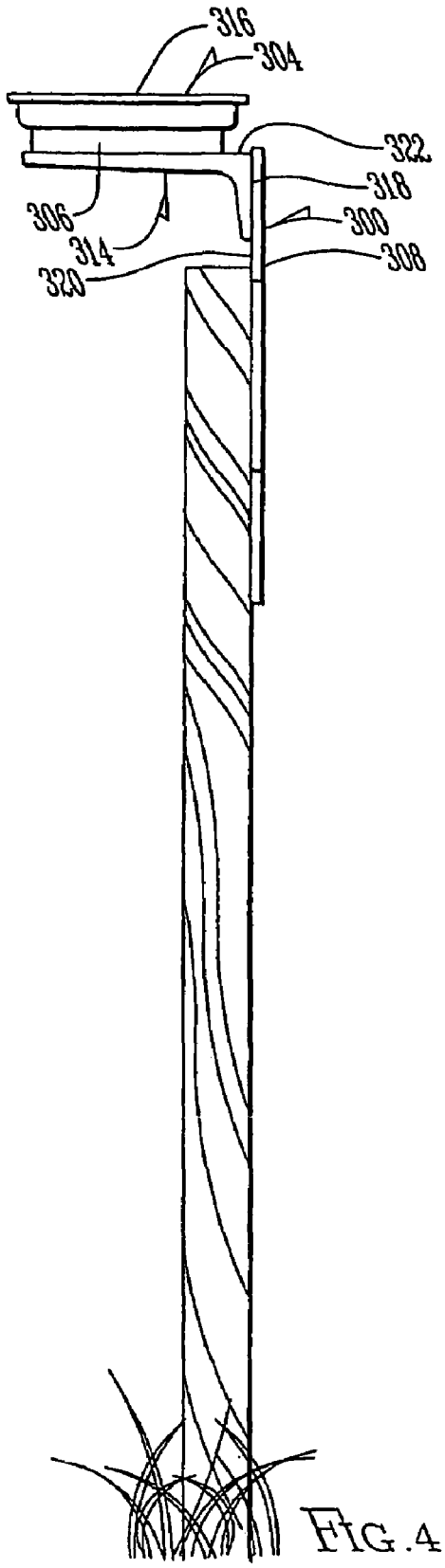
FIG. 4 is a side elevational view of a display system providing illumination for an object in accordance with an embodiment of the present invention.
Figure 5:
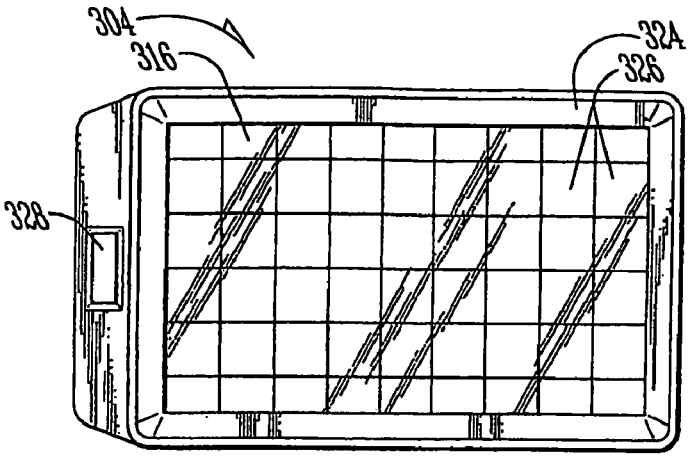
FIG. 5 is a top plan view of a photocell of a display system in accordance with an embodiment of the present invention.

Another embodiment of the present invention is presented in FIGS. 3–5 for an illumination system 300 used to provide illumination for certain objects, such as signs, navigational aids, and the like. Illumination system 300 comprises an electroluminescent lamp 302, a photocell 304 for receiving solar energy, a power supply 306 to supply electrical energy to EL lamp 302, and a control switch (not pictured) to manage the intervals of electrical energy discharge to the EL lamp for illumination. FIGS. 3 and 4 show an exemplary embodiment where illumination system 300 is affixed to a traffic sign representing the object 308.

Electroluminescent lamp 302 may be the same as the electroluminescent lamp of the embodiments of the present invention shown in FIGS. 1 and 2, and thus, may be fabricated according to the teachings of the '391 patent and using materials disclosed in U.S. patent application Ser. No. 09/815,078. However, the component layers of EL lamp 302 may be formed either in a forward or reverse build.

In a forward build arrangement, EL lamp 302 is formed either directly onto a front surface 310 of sign 308 serving as a substrate, or onto a substrate affixed to the sign. The substrate is a thin, elongate member and may be made from materials such as metals, aluminum, plastic (e.g. polycarbonate), glass, plexiglass, etc., but should be electrically insulative if the sign 308 upon which it is fixed is electrically conductive. Also, the substrate should be light-transmissive (transparent or translucent) if the substrate would block areas of sign 308 that are desired to be viewable. EL lamp 302 comprises a rear electrode formed onto either of the substrate or the sign front surface, an optional dielectric layer formed on to the rear electrode, a light emitting layer formed on the rear electrode, or if the dielectric layer is included, the light emitting layer is formed on such dielectric layer, and a transparent front electrode layer formed on the light emitting layer. Preferably, these EL lamp components are printed onto the substrate or sign 308. EL lamp 302 should also have a thickness of about 0.002 to about 0.012 inches. A light-transmissive electrically insulative materials, such as an ultraviolet coatings, can also be positioned over EL lamp 302 to reduce the risk of electric shock by contacting conductive elements of the lamp and to prevent short circuits due to exposure to environmental conditions.

According to one embodiment, a transparent light reflective layer is formed over a front surface 312 of EL lamp 302 as taught in U.S. Pat. No. 5,552,679 of Murasko, the teachings of which are incorporated by reference herewith. The light reflective layer reflects light incident on EL lamp 302 from sources such as car headlights, etc., while allowing the illumination of EL lamp 302 to be viewed therethrough by an observer. The light reflective layer may be attached to EL lamp front surface 312 by various methods such as heat bonding or by the use of transparent adhesives.

In a reverse build arrangement, EL lamp 302 is formed onto a light-transmissive substrate, such as thin, elongate member made from light-transmissive materials such as such as plastic (e.g. polycarbonate), glass, plexiglass, and the like. The substrate should be sufficiently strong as to protect the other components of El lamp 302 from exposure to environmental conditions. Alternatively, EL lamp 302 is formed onto the transparent light reflective layer. EL lamp comprises a front electrode formed onto the substrate, a light emitting layer formed on the front electrode, if an electroluminescent phosphor is used for the light emitting layer, a dielectric layer formed on the light emitting layer, and a rear electrode formed on the light emitting layer, or if the optional dielectric layer is provided, the rear electrode is formed on such dielectric layer. Preferably, these EL lamp components are printed onto the light-transmissive substrate to form an EL lamp having a thickness of about 0.002 to about 0.012 inches. EL lamp 302 may be attached to front surface 310 of sign by various methods such as heat bonding or by the use of adhesives.

FIG. 4 is a side view of illumination system 300 attached to sign 308. A mounting bracket 314 is used to mount the photocell 304 and power supply 306 to sign 308 to provide a stable platform and position photocell 304 at the proper angle in relation to the horizontal plane for receiving the maximum amount of solar energy to power electroluminescent lamp 302. For example, photocell 304 should be positioned such that it has an energy receiving surface 316 that is generally orthogonal to incoming solar energy rays from the sun for at least a portion of the day. Mounting bracket 314 has a first surface 318 configured for attachment to a back surface 320 of sign 308 and a second surface 322 configured to underlie photocell 304 and power supply 306.

Photocell 304 is shown in more detail in FIG. 5. Photocell 304 has a housing 324 to surround and protect an array of photocell elements 326 from environmental conditions. Housing 324 may be made of, for example, ABS plastic, or other materials exhibiting similar structural properties. A light sensor 328 is disposed thereon to sense the level of ambient light incident on photocell 304. Photocell elements 326 may be the same as the photocell of embodiments of the present invention shown in FIGS. 1 and 2. Photocell 304 receives solar energy and converts such energy into electrical energy for storage in power supply 306 or, alternatively, for immediate use by EL lamp 304 for illumination.

Power supply 306 stores electrical energy received from photocell 304 and transfers electrical energy to electroluminescent lamp 302 for illumination. A set of leads (not shown) electrically connect power supply 306 to EL lamp 302 to supply electrical energy to the lamp for illumination. These leads connect to the front and rear electrodes of EL lamp 302. Preferably, a portion of the leads comprise a front outlying electrode lead configured to substantially surround and electrically contact the transparent front electrode of the EL lamp, and a rear electrode lead configured to electrically contact the rear electrode of the EL lamp. Light sensor 328 may also be a light-activated day/night switch to not only sense the level of ambient light at photocell 304, but also to manage the discharge cycles of power supply 306 to EL lamp 302. For example, when ambient light conditions are reduced to a pre-determined level, the switch allows discharge of electrical energy from power supply 306 to EL lamp 302 for illumination. Conversely, upon the ambient light conditions exceeding the pre-determined level, the switches shut off the electrical energy discharge and device 106 ceases illuminating. As an alternative to the photo-activated switch, a timer switch (not shown) could control the discharge of electrical energy from power supply 306 at pre-set time intervals, such as generally at a time that would correspond to dawn and to dusk. The time switch could also be configured with a strobe feature to turn power supply discharge on and off, for example, every few seconds such that flashing illumination of EL lamp 302 is observed. Additionally, the photo-activated switches could sense when power supply 204 is fully charged and prevent the transfer of electrical energy from photocell 304 to power supply 306 to avoid overcharge damage to the power supply. Optionally, a controller (not pictured), such as a microprocessor a1 kd memory, may be electrically connected to the power supply 306. The controller varies the illumination pattern of EL lamp 302 by, for example, illuminating certain regions of the lamp at specific time intervals (i.e. successively illuminating the letters "S-T-0-P" formed on the lamp), or by varying the intensity of illumination, and may be configured to create a moving light image.

According to one embodiment, a second electroluminescent lamp 302 may be affixed to sign 308 and electrically connected to power supply 306. The controller would cause each of the EL lamps to illuminated at different time intervals and with varying intensities of illumination. In the example of a road sign as object 308, one of the EL lamps is formed at the perimeter of the sign to illuminate in the general shape of the sign. The second EL lamp is formed to provide the illuminated shape of specific letters or graphics of the sign, informing the motorist of the specific message of the sign. The second EL lamp could be illuminated at a delayed period of time after the first lamp illuminates, or both lamps could illuminate simultaneously.

It is also to be understood that the illumination system 300 of the present invention may be used to provide illumination for a multitude of objects 308, such as road signs, signal buoys, navigational aids, position markers, outdoor equipment, advertising billboards, bus shelters, phone booths or any other object or structure upon which an EL lamp 302 may be attached and where solar energy can be collected to power the illumination system.

Figure 6:
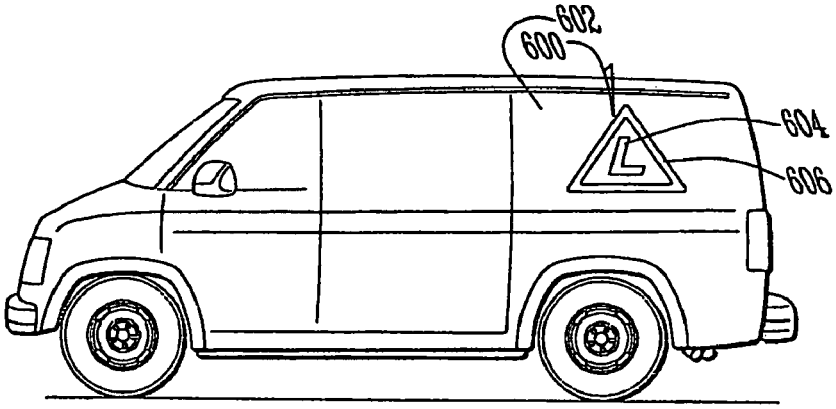
FIG. 6 is an illustrative view of an illuminated decal affixed to an object in accordance with an embodiment of the present invention.
Figure 7:
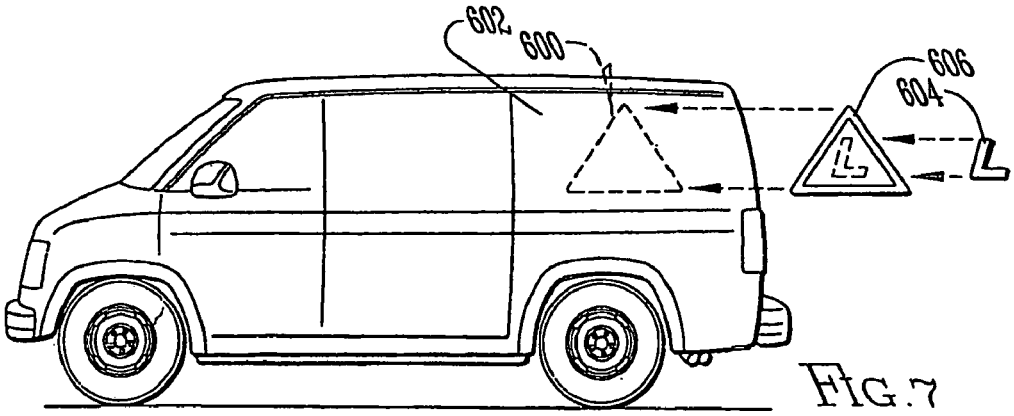
FIG. 7 is an exploded illustrative view of an illuminated decal in accordance with an embodiment of the present invention.
Figure 8:
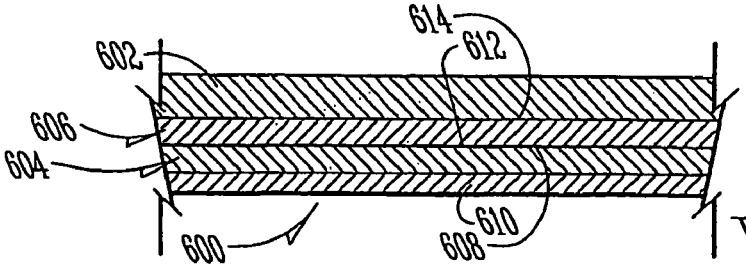
FIG. 8 is a diagram of an illuminated decal in accordance with an embodiment of the present invention.

In another embodiment of the present invention shown in FIGS. 6–8, an illuminated decal system 600 is configured to provide an illumination device that various objects 602, such as various transportation vehicles (e.g., automobiles, trucks, buses, trains, boats, airplanes, etc.), safety equipment, etc. FIGS. 6 and 7 show an exemplary embodiment where an lamp 604 is affixed to a decal backing 606 to form an illuminated decal system 600 configured to be affixed to a vehicle 602.

Electroluminescent lamp 604 may be the same as the electroluminescent lamp of the embodiments of the present invention shown in FIGS. 1 and 2, and thus, may be fabricated according to the teachings of the '391 patent and using materials disclosed in U.S. patent application Ser. No. 09/815,078. However, the component layers of EL lamp 604 may be formed either in a forward or reverse build.

In a forward build arrangement, EL lamp 604 is formed either directly onto a first surface 608 of decal backing 606 serving as a substrate, or onto a typical EL lamp substrate (i.e., a thin, planar member made from materials such as metals, aluminum, polycarbonate plastic, glass, plexiglass, etc.). EL lamp 604 comprises a rear electrode formed onto either the substrate or the decal backing first surface 608, if an electroluminescent phosphor is used for the light emitting layer, a dielectric layer formed onto the rear electrode, a light emitting layer formed onto the rear electrode, or if the optional dielectric layer is provided, the light emitting layer is formed onto the dielectric layer, and a transparent front electrode layer formed onto the light emitting layer. Preferably, these EL lamp components are printed onto the substrate or surface 308. EL lamp 604 should also have a thickness of about 0.002 to about 0.012 inches. Light-transmissive electrically insulative materials, such as an ultraviolet coatings, can also be positioned over EL lamp 604 to reduce the risk of electric shock by contacting conductive elements of the lamp and to prevent short circuits due to exposure to environmental conditions.

According to one embodiment, a transparent light reflective layer is formed over a front surface 610 of EL lamp 604 as taught in U.S. Pat. No. 5,552,679 of Murasko, the teachings of which are incorporated by reference herewith. The light reflective layer reflects light incident on EL lamp 604 from sources such as car headlights, etc., while allowing the illumination of EL lamp 604 to be viewed therethrough by an observer. The light reflective layer may be attached to EL lamp front surface 610 by various methods such as heat bonding or by the use of transparent adhesives.

In a reverse build arrangement, EL lamp 604 is formed onto a light-transmissive substrate, such as thin, elongate member made from light-transmissive materials such as such as polycarbonate plastic, glass, plexiglass, and the like. The substrate should be sufficiently strong as to protect the other components of El lamp 302 from exposure to environmental conditions. Alternatively, EL lamp 604 is formed onto the transparent light reflective layer. EL lamp comprises a front electrode formed onto the substrate, a light emitting layer formed on the front electrode, if an electroluminescent phosphor is used for the light emitting layer, a dielectric layer formed on the light emitting layer, and a rear electrode formed on the light emitting layer, or if the optional dielectric layer is provided, the rear electrode is formed on such dielectric layer. An electrically insulative layer, such as an ultraviolet coatings or a urethane layer, can also be positioned over the rear electrode to protect the integrity of the EL lamp 604. Preferably, these EL lamp components are printed onto the light-transmissive substrate to form an EL lamp having a thickness of about 0.002 to about 0.012 inches.

Decal backing 606, may be fabricated of any number of durable and chemically stable materials, such as plastics, rubbers, etc. An adhesive, such as a Vinyl adhesive, may be used to attach a back surface 612 of EL lamp 604 to decal backing front surface 608. If EL lamp 604 is fabricated in a forward build arrangement directly onto decal backing first surface 608, then an adhesives is unnecessary. Also, if EL lamp 604 is fabricated in a reverse build arrangement, the adhesive is ideally positioned on areas of the lamp substrate where conductive elements are not exposed, or if provided, onto the electrically insulative layer. Once EL lamp 604 is affixed to decal backing 606, a second surface 614 of decal backing assembly may be affixed to vehicle 602 using an adhesive (e.g., vinyl adhesive) or other attachment means, such as heat bonding, to fixedly position illuminated decal system 600 on vehicle 602.

In an alternative embodiment, magnetic material may be attached or bonded to EL lamp back surface 612 such that EL lamp 604 can be removably positioned on a surface that is magnetically attracted to the magnetic material, such as a surface made of steel or iron. The magnetic material chosen should be sufficient to support the weight of EL lamp 604 while maintaining magnetic attraction to vehicle 602. This embodiment dispenses with the need for decal backing 606.

A set of leads (not shown) electrically connect a power source (not shown) to EL lamp 604 to bring electrical energy to the lamp for illumination. Preferably, at least a portion of the leads comprise a front outlying electrode lead configured to substantially surround and electrically contact the transparent front electrode of the EL lamp, and a rear electrode lead configured to electrically contact the rear electrode of EL lamp. The power source could be that as described in the embodiments in FIGS. 1 and 2, i.e., a rechargeable thin-film battery, formed onto the EL lamp substrate, but preferably is the power source of the vehicle 602. The leads should be appropriately weatherproofed (i.e., electrically insulated) as they may be exposed to environmental conditions if they extend along the vehicle exterior to reach the EL lamp 604. A switch mechanism (not shown) may be provided inside the vehicle 602 and electrically connected to the leads to control the discharge of electrical energy from the power source to the EL lamp 604 for illumination thereof (i.e. turn the lamp illumination on or off, varying the level of illumination, etc.). The switch could also be a timer switch. Optionally, a controller (not pictured), such as a microprocessor and memory, may be electrically connected to the power source to vary the illumination pattern of EL lamp 302 as described for the embodiments of FIGS. 3–5.

The illuminated decal system 600 of the present invention shown provides an illumination source that is lightweight, easy to install on may objects, such as vehicles, low maintenance, and can be configured to deliver an illuminated image of a particular logo or icon on a moving object.

The invention claimed is:

1. A luminescent display system, comprising:

a substrate having first and second opposed surfaces an electroluminescent lamp having a front illumination surface and a back surface affixed to a first surface of said substrate;

a photocell affixed to a surface of said substrate in close proximity to the electroluminescent lamp for generating an electrical energy from solar energy; and a power supply affixed to a surface of said substrate in close proximity to the electroluminescent lamp and photocell;

said power supply being electrically connected to the photocell for receiving and storing the electrical energy from the photocell, and electrically connected to the electroluminescent lamp for discharging the electrical energy to the lamp.

2. The system of claim 1, further including a control switch electrically connected to the power supply controlling discharge of the electrical energy from the power supply to the first electroluminescent lamp at certain intervals to control the illumination of the lamp.

3. The system of claim 2, wherein the control switch is a timer.

4. The system of claim 2, wherein the control switch is a light sensor that controls discharge of electrical energy to the first electroluminescent lamp relative to ambient light conditions sensed in the environment.

5. The system of claim 2, wherein the control switch is a strobe switch that allows intermittent discharge of electrical energy to the first electroluminescent lamp.

6. The system of claim 1, wherein the back surface of the electroluminescent lamp is affixed to the substrate using an adhesive.

7. The system of claim 1, wherein the electroluminescent lamp is screen printed onto the substrate.

8. The system of claim 1, wherein the photocell is mounted on the second surface of the substrate.

9. The system of claim 1, wherein the object comprises a structure selected from the group consisting of a sign, a buoy, and a marker.

10. The system of claim 1 wherein the front illumination surface of the electroluminescent lamp is provided with a transparent light reflective layer for reflecting incident light independent of the illumination provided by the lamp.

11. The system of claim 1, wherein the electroluminescent lamp comprises a light emitting polymer layer disposed between two electrodes.

12. The system of claim 1, wherein the electroluminescent lamp comprises a phosphor layer disposed between two electrodes.

13. The system of claim 1, wherein the electroluminescent lamp comprises a first electroluminescent lamp, which comprises:

a light-transmissive substrate layer forming the front illumination surface;

a transparent front electrode disposed on the substrate layer;

an illumination layer disposed on the transparent front electrode layer;

a rear electrode disposed on the illumination layer and a rear insulating layer disposed on the rear electrode and forming the back surface.

14. The system of claim 1, wherein the electroluminescent lamp comprises:

a lamp substrate layer forming the back surface;

rear electrode disposed on the lamp substrate layer;

an illumination layer disposed on the rear electrode;

a transparent front electrode disposed on the illumination layer; and a light-transmissive insulating layer disposed on the transparent front electrode and forming the front illumination surface.

15. The system of claim 1, further including control electronics for illuminating different sections of the electroluminescent lamp at varying time intervals.

16. The system of claim 13, further including a second electroluminescent lamp electrically connected to the power supply, and wherein the control electronics illuminates the first electroluminescent lamp and the second electroluminescent lamp at varying time intervals.

17. A method of illuminating an object, comprising:

affixing an electroluminescent lamp, a power supply and a photocell to a substrate having first and second opposed surfaces; said devices being in close proximity to one another receiving solar radiation into the photocell;

storing electrical energy generated by the photocell in the power supply; and transferring the electrical energy from the power supply to the electroluminescent lamp to illuminate an object.

18. The method of claim 17, wherein the object comprises a structure selected from the group consisting of a sign, a buoy, and a marker.

19. The method of claim 17, further comprising controlling the transfer of electrical energy to the electroluminescent lamp through a control switch to control the transfer of electrical energy from the power supply to the electroluminescent lamp.

20. The method of claim 19, wherein the control switch effects the illumination of a first portion of the object during a first time interval and effects the illumination of a second portion of the object during a second time interval.

21. An integrated light emitting assembly, comprising:

a light-transmissive substrate having first and second opposed surfaces a battery formed onto one surface of the substrate; and a proximate light emitting device formed onto one surface of the substrate and electrically connected to the battery for receiving electrical energy from the battery.

22. The assembly of claim 21, wherein the battery is printed onto one surface of the substrate and the light emitting device is printed onto one surface of the substrate.

23. The assembly of claim 21, wherein the light emitting device comprises a light emitting polymer layer disposed between first and second electrodes.

24. The assembly of claim 21, wherein the light emitting assembly is an electroluminescent lamp comprising:

a transparent front electrode printed on one surface of the substrate;

a light emitting layer printed on the transparent front electrode layer; and a rear electrode printed on the light emitting layer.

25. The assembly of claim 24 wherein the light emitting layer comprises a light emitting polymer layer.

26. An integrated light emitting assembly, comprising:

a light-transmissive assembly substrate having a front and a back surface;

a photocell formed onto the back surface of the substrate;

a rechargeable power supply formed onto the back surface of the substrate adjacent to the photocell and electrically connected to the photocell; and a light emitting device electrically connected to the rechargeable power supply and formed onto the back surface of the substrate.

27. The assembly of claim 26, wherein the rechargeable power supply and the light emitting device are both printed onto the back surface of the assembly substrate.

28. The assembly of claim 26, wherein the power supply is a battery.

29. The assembly of claim 26, wherein the light emitting device comprises a light emitting polymer layer disposed between first and second electrodes.

30. The assembly of claim 26, further comprising a light-activated switch connected to the rechargeable power supply to vary discharging of the rechargeable power supply to the light emitting device in response to the level of ambient light detected.

31. The assembly of claim 26, wherein the light emitting device is an electroluminescent lamp comprising:

transparent front electrode printed on the back surface of the assembly substrate;

light emitting layer printed on the transparent front electrode layer; and rear electrode printed on the light emitting layer.

32. The assembly of claim 31, wherein the light emitting layer comprises a light emitting polymer layer.

* * * * *